US007432864B1

(12) United States Patent
Yang et al.

(10) Patent No.: US 7,432,864 B1
(45) Date of Patent: Oct. 7, 2008

(54) MODULARIZED PLANAR ANTENNA STRUCTURE

(75) Inventors: Tsai-Yi Yang, Tainan Hsien (TW); Te-Yi Chu, Tainan Hsien (TW)

(73) Assignee: Cirocomm Technology Corp., Tainan (TW)

( * ) Notice: Subject to any disclaimer, the term of this patent is extended or adjusted under 35 U.S.C. 154(b) by 0 days.

(21) Appl. No.: 11/688,905

(22) Filed: Mar. 21, 2007

(51) Int. Cl.
*H01Q 1/38* (2006.01)
*H01Q 1/12* (2006.01)

(52) U.S. Cl. ..... 343/700 MS; 343/878

(58) Field of Classification Search ..... 343/700 MS, 343/702, 845, 878
See application file for complete search history.

(56) References Cited

U.S. PATENT DOCUMENTS 5,410,749 A * 4/1995 Siwiak et al. ..... 455/280
6,298,243 B1 * 10/2001 Basile ..... 455/552.1
6,683,570 B2 * 1/2004 Skladany et al. ..... 343/700 MS
2005/0068236 A1 * 3/2005 Noro ..... 343/713

* cited by examiner

*Primary Examiner*—Shih-Chao Chen

(57) ABSTRACT

A modularized planar antenna structure includes an antenna unit, a connection unit, a circuit board and a cover. The modularized planar antenna structure connects the antenna unit and circuit board. The antenna unit includes a signal feeder electrically connected the circuit board at end thereof such that the antenna unit is vertical to the circuit board. The cover is assembled to the circuit to protect the circuit board from electromagnetic interference or strike of external article. When the antenna structure is assembled to a main circuit board of an electronic device, the circuit board can be directly assembled to the main circuit board of an electronic device and the circular-polarized antenna unit points toward zenith direction to receive satellite signal.

19 Claims, 8 Drawing Sheets

MODULARIZED PLANAR ANTENNA STRUCTURE

FIELD OF THE INVENTION

The present invention relates to an antenna, especially to an antenna for receiving satellite signal.

DESCRIPTION OF PRIOR ART

GPS is the acronym of "Global Position System", which uses trigonometry positioning principle and measures distance by transmission time of wireless signal. At least three satellites are used to calculate the distances between them and target and positioning of target can be obtained by built-in map in the GPS receiver.

The current vehicle navigation system is developed to incorporate with vehicle video system and can be implemented in the form of PDA, Notebook computer and mobile phone. Among them, the most attractive is the portable Global Position System (portable GPS). The portable GPS can be easily installed in car without equipping with GPS system and can be used in another car or off the car.

When the GPS unit is integrated with electronic devices such as PDA, Notebook computer and mobile phone, the electronic devices generally include a built-in antenna. With reference to FIG. 1, an antenna unit 1A is arranged horizontally on a circuit board 2A and then the circuit board 2A is embedded into fixing groove 31A of chassis 3A. The antenna unit 1A is electrically connected to a main board 5A through a wire 4A. Therefore, the satellite signal processed by the circuit board 2A is sent to the main board 5A for displaying the processed data on the electronic devices. However, the electronic devices s integrated with GPS unit shown in FIG. 1 has time consuming assemble and high manufacture cost.

SUMMARY OF THE INVENTION

It is an object of the present invention to provide a modularized planar antenna structure, wherein the antenna structure can be directly surface soldered to a main circuit board of an electronic device while the planar antenna structure still keeps directivity toward zenith. The modular design can reduce cost and assembling effort.

Accordingly, the present invention provides a modularized planar antenna structure, comprising:

an antenna unit comprising a ceramic base, a radiation metal plate on a face of the base, a ground metal plate on bottom face of the base; a through hole defined through the base, the radiation metal plate and the ground metal plate, a signal feeder passing through the through hole and including a hemisphere end for electrically connecting to the radiation metal plate such that the radiation metal plate can be a signal reception end, another end of the signal feeder being not in contact with the ground metal plate, the base comprising four lateral faces and a coupling face between two adjacent lateral faces;

a connection unit connected to the bottom of the antenna unit and including a bottom plate with a pass hole, the end of the signal feeder passing the pass hole for contacting to the circuit board, the bottom plate including a plurality of clamping plates for clamping to the coupling plate, the bottom plate including two symmetric connection plates, each of the connection plate including a bump for connecting to the circuit board;

a circuit board including an assembling hole for connecting to the bump and two symmetric dents; and a cover assembled with the dent of circuit board, the cover including a top plate, two symmetric side plates on both sides of the top plate, each side plate comprises a flange.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
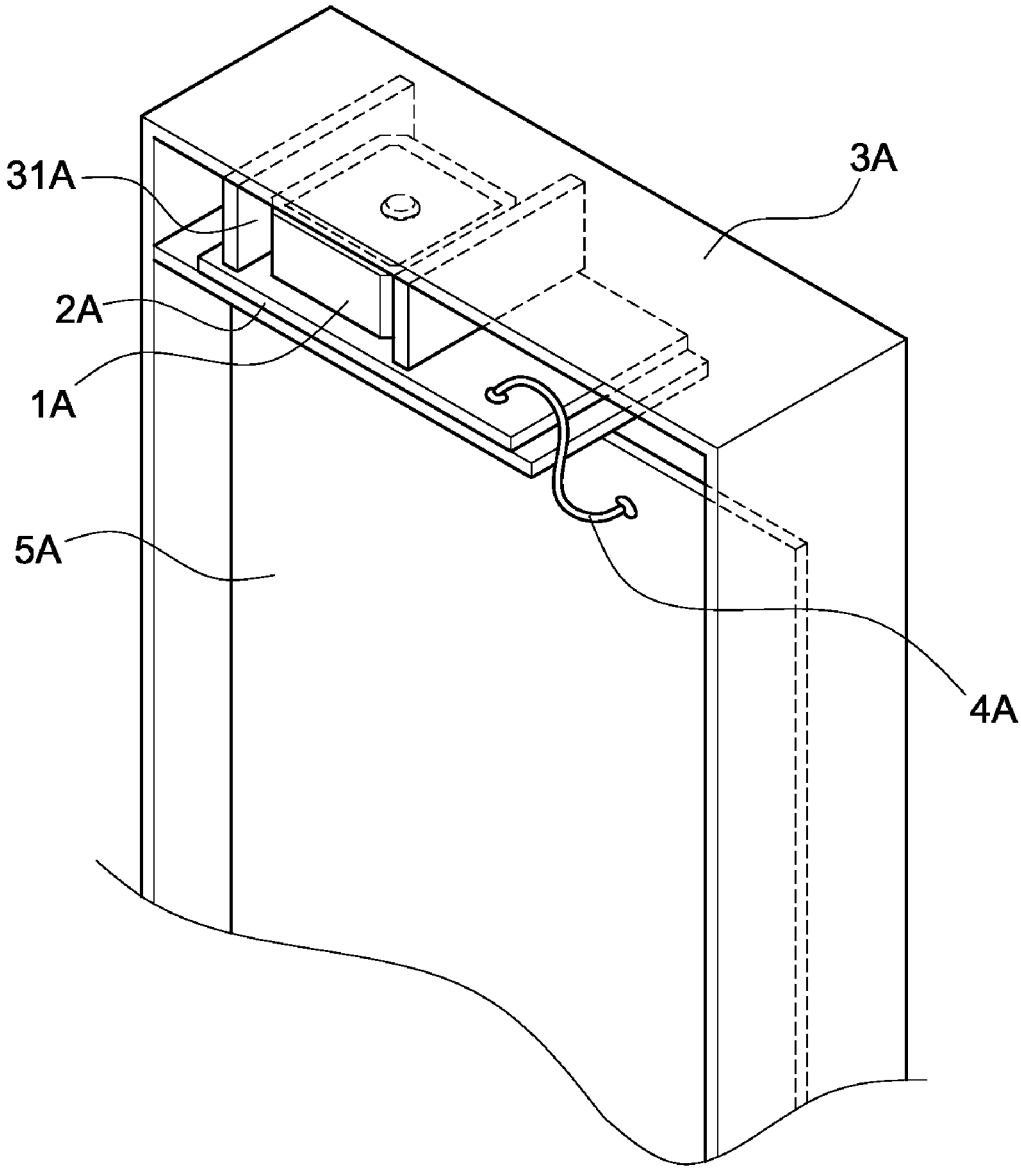
FIG.1 (Prior Art)
FIG. 1 shows a prior art antenna.
Figure 2:
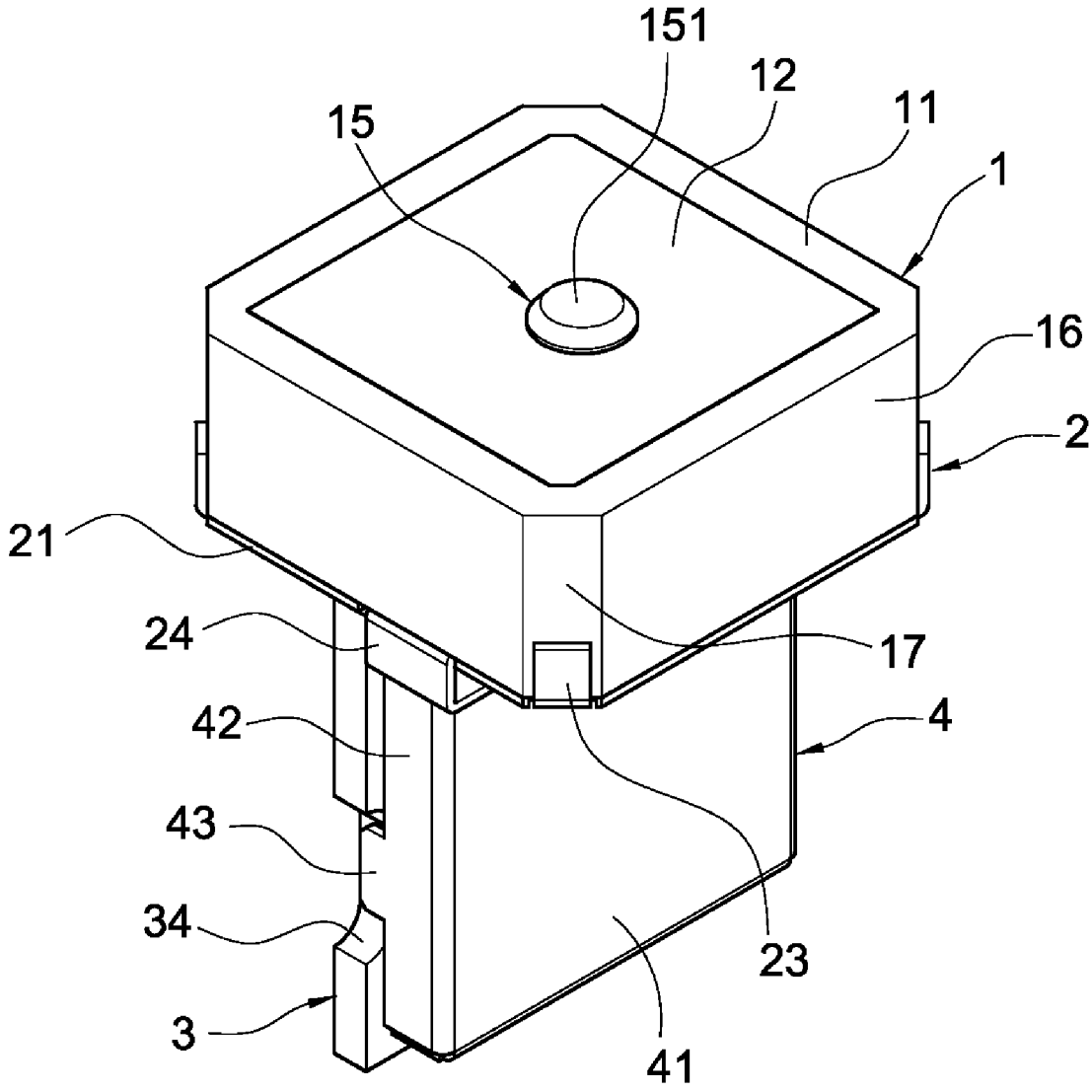
FIG. 2 shows a perspective view of the antenna structure according to the present invention.
Figure 3:
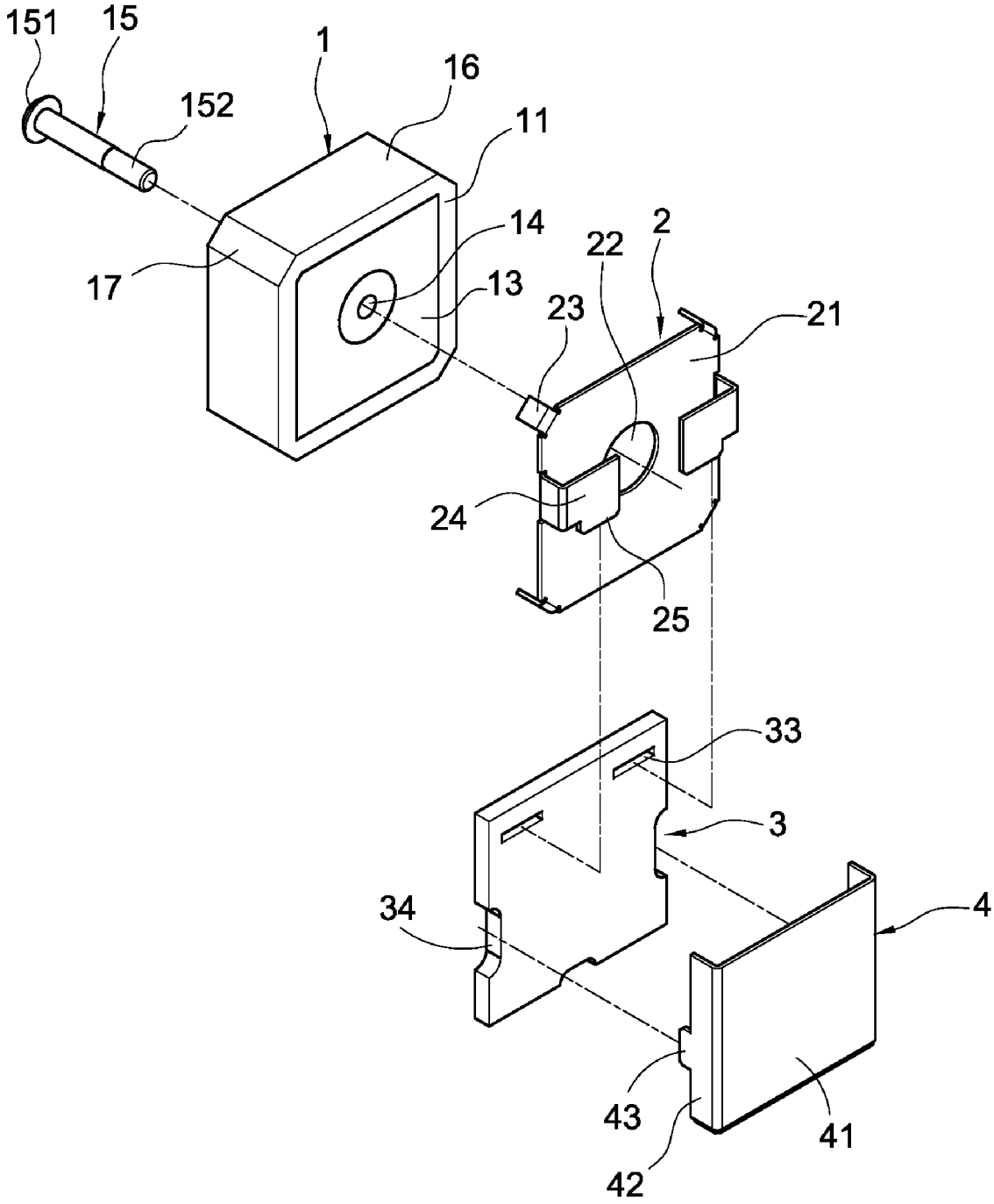
FIG. 3 shows an exploded view of the antenna structure according to the present invention.

With reference to FIGS. 2 and 3, the modularized planar antenna of the present invention comprises an antenna unit 1, a connection unit 2, a circuit board 3 and a cover 4. The connection unit 2 connects the antenna unit 1 and the circuit board 3 such that the antenna unit 1 is vertical to the circuit board 3.

The antenna unit 1 is a square planar antenna and comprises a ceramic base 11 with a radiation metal plate 12 on top surface thereof and a ground metal plate 13 on bottom thereof. A through hole 14 is defined on the ceramic base 11, the radiation metal plate 12 and the ground metal plate 13, and a T-shaped signal feeder 15 passes through the through hole 14. The T-shaped signal feeder 15 comprises a hemisphere first end 151 for electrically connecting to the radiation metal plate 12. A second end 152 of the T-shaped signal feeder 15 passes the ground metal plate 13. The second end 152 of the T-shaped signal feeder 15 is not electrically connected to the ground metal plate 13, but electrically connected to the circuit board 3 such that the received signal of the antenna unit 1 can be directly sent to the circuit board 3. The base 11 comprises four lateral faces 16 on lateral sides thereof. A coupling face 17 with smaller area than that of the lateral face 16 is provided between two adjacent lateral faces 16 for the assembling of the connection unit 2.

The connection unit 2 is assembled on the bottom of the antenna unit 1 and comprises a bottom plate 21 on bottom thereof and having the shape same as the top face or bottom face of the antenna unit 1. A pass hole 22 is defined on the bottom plate 21. Through the pass hole 22, the second end 152 of the T-shaped signal feeder 15 is passed and soldered to the circuit board 3. A plurality of clamping plates 23 extends upward from four corners of the bottom plate 21. The clamping plates 23 clamp to the coupling face 17 of the antenna unit 1. Two symmetric L-shaped connection plates 24 are downward extended from two sides of the bottom plate 21. A bump 25 is provided on one side of the connection plate 24 and is electrically connected to the circuit board 3.

Figure 4A:
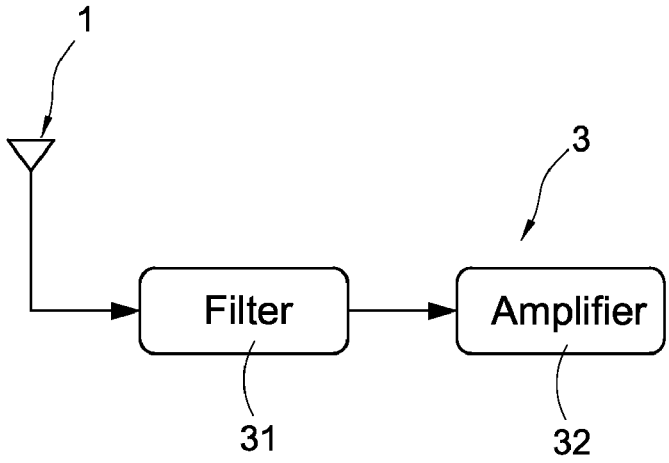
FIG. 4A shows block diagram of the circuit board according to the present invention.
Figure 4B:
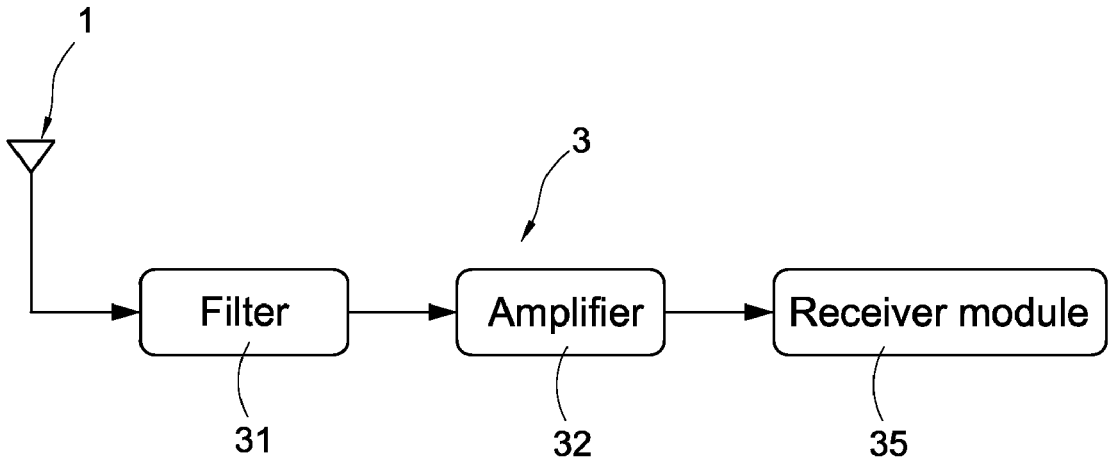
FIG. 4B shows block diagram of another circuit board according to the present invention.

With reference to FIG. 4A and FIG. 4B, the circuit board 3 carries a conventional circuitry. The conventional circuitry comprises a filter 31 and an amplifier 32. The filter 31 is used to filter the noise in signal and the filtered signal is sent to the main circuit board of the electronic device after the amplification of the amplifier 32. Alternatively, a receiver module 35 (such as circuit in the GPS unit) is manufactured on the same circuit board 3 with the filter 31 and the amplifier 32. The filter 31 is used to filter the noise in signal and the filtered signal is sent to the receiver module 35 after the amplification of the amplifier 32. The amplified signal is processed in the receiver module 35 and then sent to the main circuit board of the electronic device. Therefore, the portable electronic device can display image and information related to the GPS unit. An assembling hole 33 is defined on one side of the circuit board 3 and connected to the bump 25. The circuit board 3 comprises two symmetric dents 34 on other two sides thereof and used for assembling with a protective cover 4.

The cover 4 is a U-shaped cover and made of metal material. The cover 4 comprises a top plate 41 and two side plates 42. Each of the side plates 42 is provided with a flange 43. The flange 43 is fixed to the dent 34 to protect the circuit board from electromagnetic interference or strike of external article.

Figure 5:
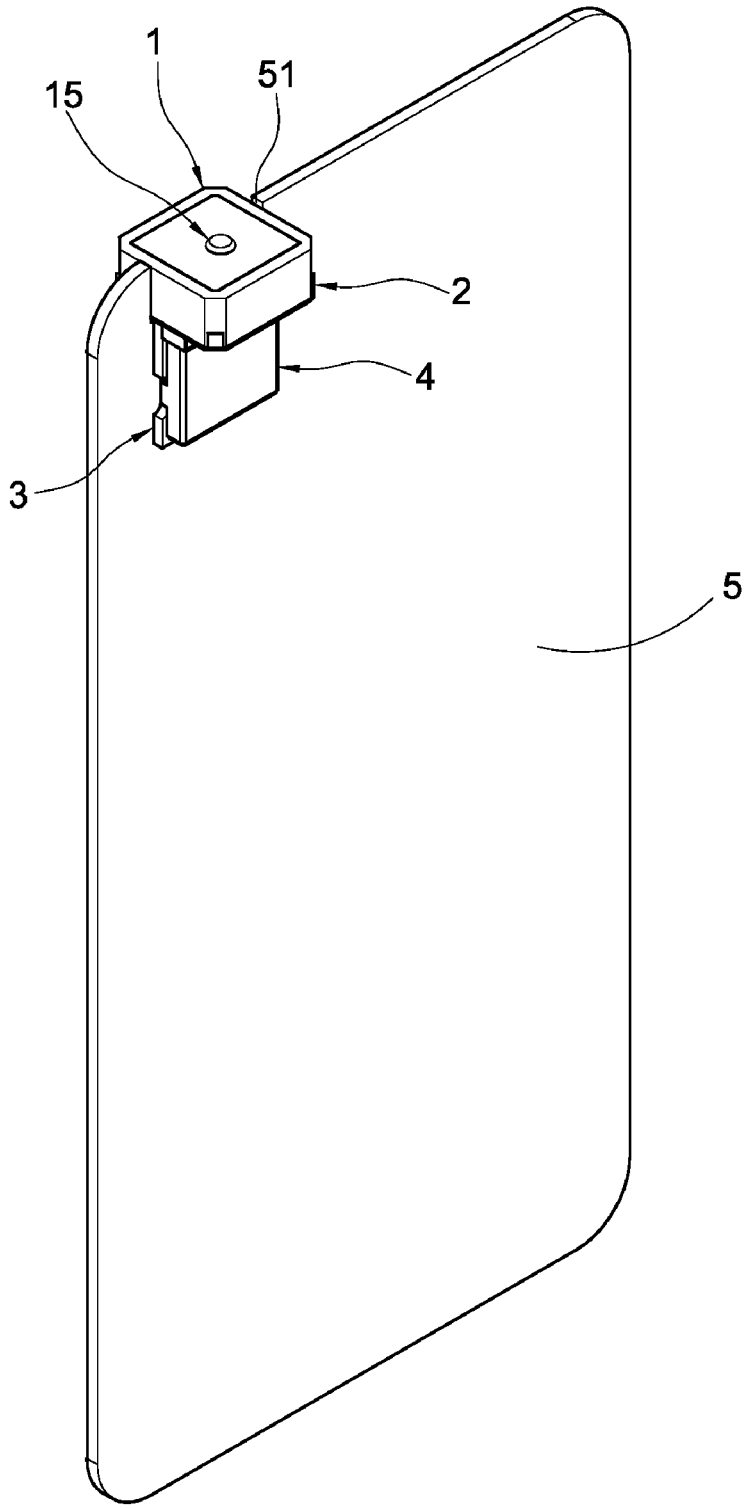
FIG. 5 is a perspective view showing the connection of the antenna structure according to the present invention with a main circuit board of an electronic device.
Figure 6:
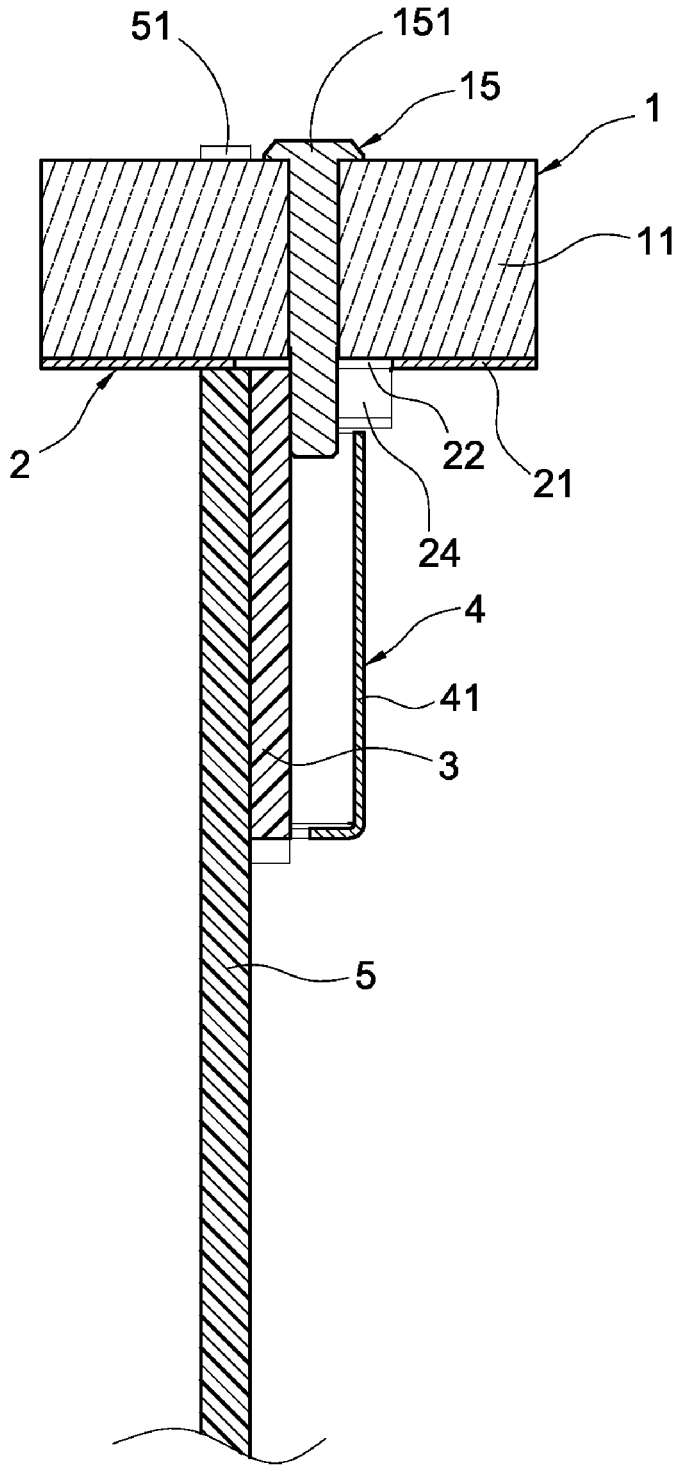
FIG. 6 is a sectional view showing the connection of the antenna structure according to the present invention with a main circuit board of an electronic device.

With reference to FIGS. 5 and 6, when the connection unit 2 is fixed to bottom of the antenna unit 1, the clamping plate 23 clamps to the coupling face 17 of the antenna unit 1. The second end 152 of the signal feeder 15 is soldered to and electrically connected to the circuit board after passing the pass hole 22. The bump 25 of the connection plate 24 is coupled with the coupling hole 33 of the circuit board 3 and then the flange 43 is assembled to the dent 34 of the circuit board 3.

After the antenna unit 1 and the circuit board 3 is connected through the connection unit 2, the antenna unit 1 is vertical to the circuit board 3 and the radiation metal plate 12 faces upward for signal reception. When the antenna module is to be connected to the main circuit board 5 of the electronic device, the circuit board 3 is soldered and fixed to the main circuit board 5 and the antenna unit 1 is received in the depression 51 of the main circuit board 5 of the electronic device. In this way, the circuit board 3 of antenna module no longer needs to fix to the casing of the electronic device. The circuit board 3 of antenna module is electrically connected to the main circuit board 5 of the electronic device to reduce contact number and prevent signal attenuation.

Figure 7:
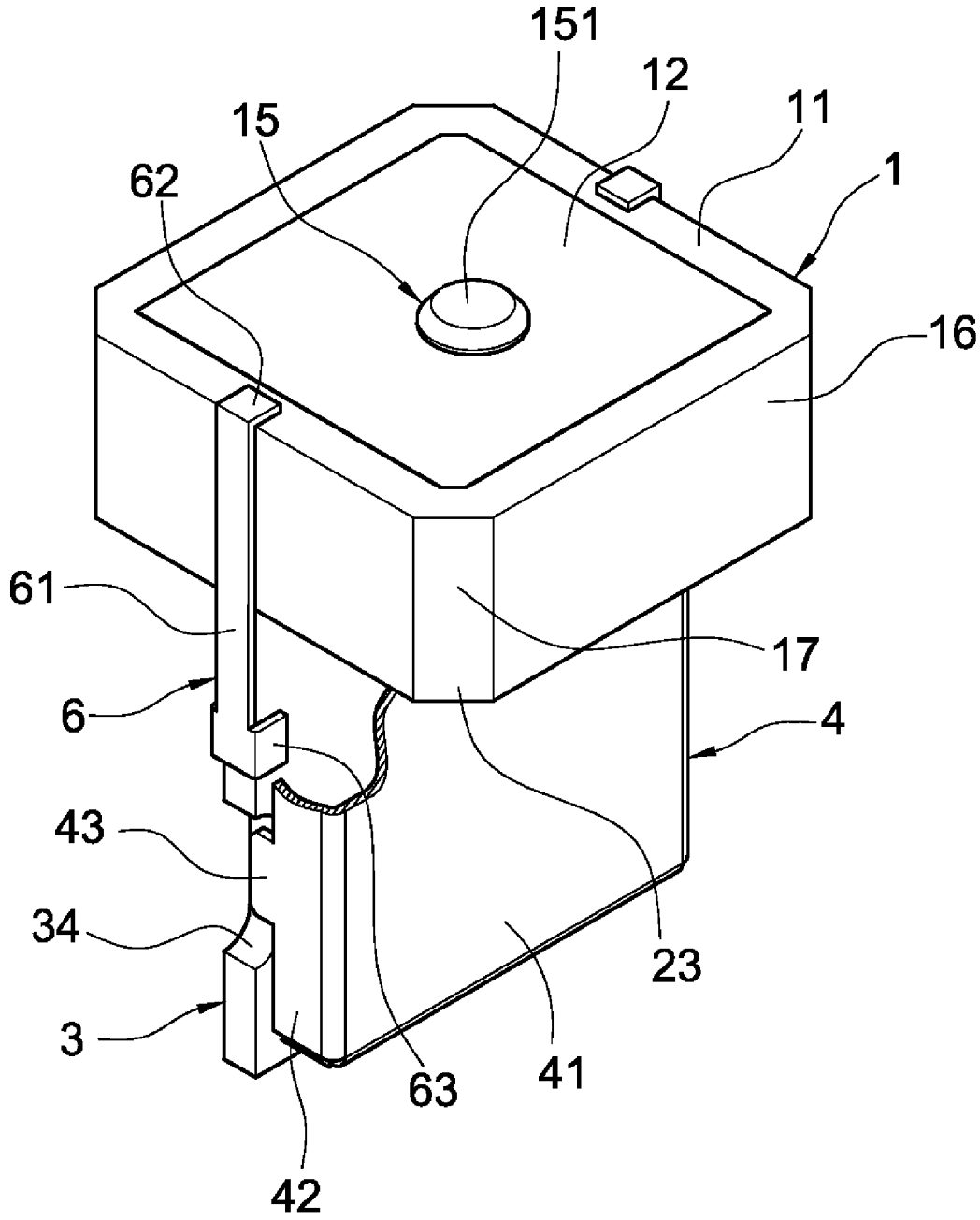
FIG. 7 shows a perspective view of the antenna structure according to another preferred embodiment of the present invention.

With reference to FIG. 7, the modularized planar antenna in this figure is similar to that shown in FIGS. 2 and 3 except that the connection unit 6 comprises an elongated panel 61 and a bent L-shaped locker 62 locked to the surface of the antenna unit 1. The panel 61 comprises two clamping tabs 63 on two opposite sides of another end thereof. The clamping tabs 63 clamp to the circuit board 3. The antenna unit 1 is vertical to the circuit board 3 after the antenna unit 1 and the circuit board 3 are connected through the connection unit 6.

Figure 8:
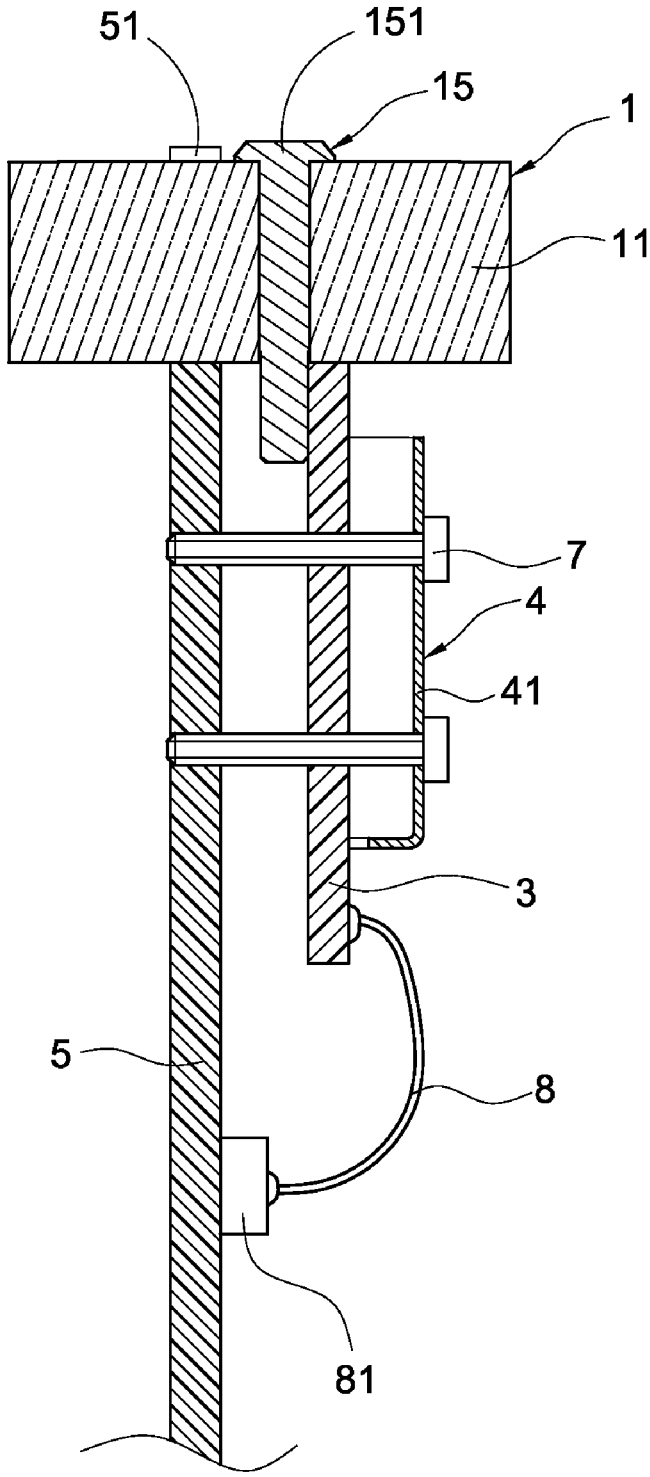
FIG. 8 shows a sectional view of the antenna structure according to still another preferred embodiment of the present invention.

FIG. 8 shows a sectional view of the antenna structure according to still another preferred embodiment of the present invention. After the antenna unit 1, the connection unit 2, the circuit board 3 and the protective cover 4 are assembled; the antenna structure can be fixed to the main circuit board 5 of the electronic device by either set screws 7 or supporting rack. The antenna structure is electrically connected to the main circuit board 5 of the electronic device through connection wire 8 and connector 81. In the shown arrangement scheme, the antenna structure is still vertical to the main circuit board 5, or the antenna structure and the main circuit board 5 form a T-shaped module. Therefore, the antenna structure will occupy less area on the main circuit board 5. The antenna structure is still oriented upward when the electronic device is used.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A modularized planar antenna structure electrically connecting an antenna to a main circuit board of an electronic device, the modularized planar antenna structure comprising:

an antenna unit comprising a base, a radiation metal plate on a face of the base, a ground metal plate on bottom face of the base, the radiation metal plate electrically connected to a signal feeder passing through the base and the ground metal plate;

a circuit board electrically connected to end of the signal feeder; and a connection unit connected to the antenna unit and the circuit board such that the antenna unit and the circuit board form a T-shaped module.

2. The modularized planar antenna structure as in claim 1, wherein the antenna is a square planar antenna.

3. The modularized planar antenna structure as in claim 1, wherein the base is a ceramic base.

4. The modularized planar antenna structure as in claim 1, wherein a through hole is defined on the base, the radiation metal plate and the ground metal plate.

5. The modularized planar antenna structure as in claim 1, wherein the signal feeder is of T shape and used for signal feeding end, the signal feeder comprises a hemisphere end.

6. The modularized planar antenna structure as in claim 1, wherein the circuit board comprises a filter and an amplifier.

7. The modularized planar antenna structure as in claim 1, wherein the circuit board comprises a filter, an amplifier and a receiver module.

8. The modularized planar antenna structure as in claim 7, wherein the receiver module is a GPS unit.

9. The modularized planar antenna structure as in claim 1, wherein the antenna structure is fixed to the main circuit board by a set screw; and the antenna structure is electrically connected to the main circuit board through a connection wire and a connector.

10. A modularized planar antenna structure electrically connecting an antenna to a main circuit board of an electronic device, the modularized planar antenna structure comprising:

an antenna unit comprising a base, a radiation metal plate on a face of the base, a ground metal plate on bottom face of the base, the radiation metal plate electrically connected to a signal feeder passing through the base and the ground metal plate;

a circuit board electrically connected to end of the signal feeder; and a connection unit connected to the antenna unit and the circuit board such that the antenna unit is vertical to the circuit board;

wherein the base comprises four lateral faces on lateral sides thereof, a coupling face with smaller area than that of the lateral face being provided between two adjacent lateral faces for the assembling of the connection unit.

11. A modularized planar antenna structure electrically connecting an antenna to a main circuit board of an electronic device the modularized planar antenna structure comprising:

an antenna unit comprising a base, a radiation metal plate on a face of the base, a ground metal plate on bottom face of the base, the radiation metal plate electrically connected to a signal feeder passing through the base and the ground metal plate;

a circuit hoard electrically connected to end of the signal feeder; and a connection unit connected to the antenna unit and the circuit board such that the antenna unit is vertical to the circuit hoard;

wherein the connection unit is assembled to the bottom of antenna unit, the connection unit comprises a bottom plate, a pass hole defined on the bottom plate and used for the passing of the signal feeder, the bottom plate comprising a plurality of clamping plates assembled with the base, two connection plates extended downward from the bottom plate and each of the connection plate comprising a bump.

12. The modularized planar antenna structure as in claim 11, wherein the connection plate is of L shape.

13. The modularized planar antenna structure as in claim 11, wherein the circuit board comprises an assembling hole for assembling with the bump and comprises two symmetric dents.

14. The modularized planar antenna structure as in claim 13, further comprising a cover assembled with the dent of circuit board, the cover comprises a top plate, two symmetric side plates on both sides of the top plate, each side plate comprises a flange.

15. The modularized planar antenna structure as in claim 14, wherein the cover is of U shape.

16. A modularized planar antenna structure electrically connecting an antenna to a main circuit board of an electronic device the modularized planar antenna structure comprising:

an antenna unit comprising a base a radiation metal plate on a face of the base, a ground metal plate on bottom face of the base, the radiation metal plate electrically connected to a signal feeder passing through the base and the ground metal plate;

a circuit board electrically connected to end of the signal feeder; and a connection unit connected to the antenna unit and the circuit board such that the antenna unit is vertical to the circuit board;

wherein the connection unit comprises a panel with a locker at one end thereof and locked to the antenna unit, and two bent clamping tabs at another end thereof and locked to two sides of the circuit board.

17. The modularized planar antenna structure as in claim 16, wherein the panel is of elongated shape.

18. The modularized planar antenna structure as in claim 16, wherein the locker is of L shape.

19. The modularized planar antenna structure as in claim 16, wherein the connection unit is connected to two sides of the antenna unit and the circuit board such that the antenna unit is vertical to the circuit board.

* * * * *